US005199924A

United States Patent [19]

Fitzgibbons

[11] Patent Number: 5,199,924

[45] Date of Patent: Apr. 6, 1993

[54] STRUCTURE FOR AND METHOD OF MAKING OVERLAPPING MULTIPART BUSINESS FORM UNIT SETS

[75] Inventor: Gary W. Fitzgibbons, Barrington, Ill.

[73] Assignee: Uarco Incorporated, Barrington, Ill.

[21] Appl. No.: 720,215

[22] Filed: Jun. 20, 1991

[51] Int. Cl.[5] ..... B42D 15/00

[52] U.S. Cl. ..... 462/26; 283/62

[58] Field of Search ..... 462/26; 283/62, 63.1, 283/81; 281/15.1, 16; 428/40, 42

[56] References Cited

U.S. PATENT DOCUMENTS

| | | | |
|---|---|---|---|
| 1,003,326 | 9/1911 | Broudy . | |
| 3,856,332 | 12/1974 | Snedeker . | |
| 3,861,718 | 1/1975 | Strus . | |
| 4,346,917 | 8/1982 | Clancy . | |
| 4,615,929 | 10/1986 | Alexander, Jr. | 283/62 X |
| 4,643,455 | 2/1987 | North et al. . | |
| 4,697,970 | 10/1987 | Hanson . | |
| 4,714,276 | 12/1987 | Greig | 283/63.1 |
| 4,789,187 | 12/1988 | Corlew et al. . | |
| 4,842,919 | 6/1989 | David et al. . | |
| 4,882,211 | 11/1989 | McIntyre et al. . | |
| 4,938,414 | 7/1990 | Lippert . | |
| 4,955,640 | 9/1990 | Anderson | 283/81 X |
| 5,050,909 | 9/1991 | Mertens et al. | 281/16 X |

*Primary Examiner*—Mark Rosenbaum
*Assistant Examiner*—Willmon Fridie, Jr.
*Attorney, Agent, or Firm*—Wood, Phillips, VanSanten, Hoffman & Ertel

[57] ABSTRACT

A structure and method for making overlapping multipart business form unit sets is provided. A repositionably adhered sheet segment unit includes at least two sheet segments having a front side and a back side in corresponding edges. The sheet segments are in side-by-side relation, such that adjacent edges overlap defining an interface. A repositionable adhesive strip is located on at least one of the overlapping edges of the adjacent segments defining an interface. At least one of the front and back sides of at least one of the sheet segments has an image transfer medium coating. The method of making an overlapping multipart business form unit set includes providing a repositionable adhesive sheet segment unit and printing indicia on at least one of the sheet segments with a printer. The sheet segments are then separated by breaking the adhesion at the overlapping edges. The segments are then repositioned and adhered by the repositionable adhesive so that the segments overlie one another to provide a unit set.

31 Claims, 3 Drawing Sheets

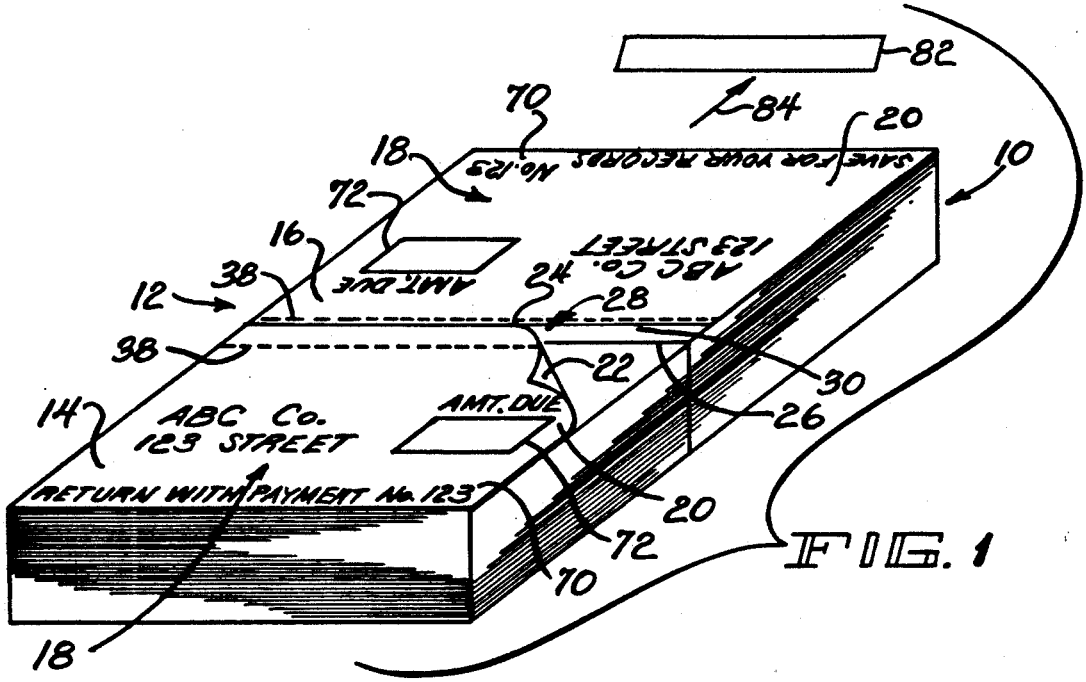
FIG. 1
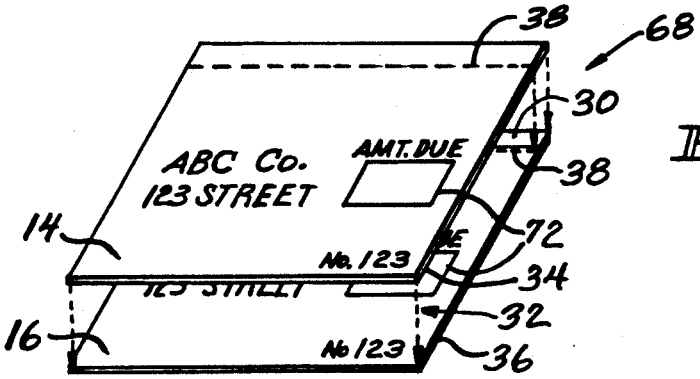
FIG. 2
FIG. 3
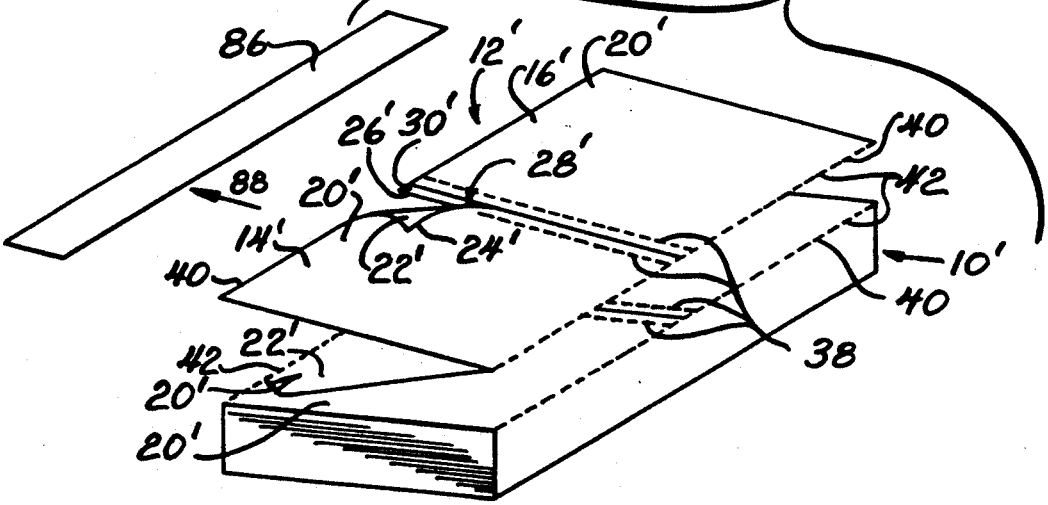

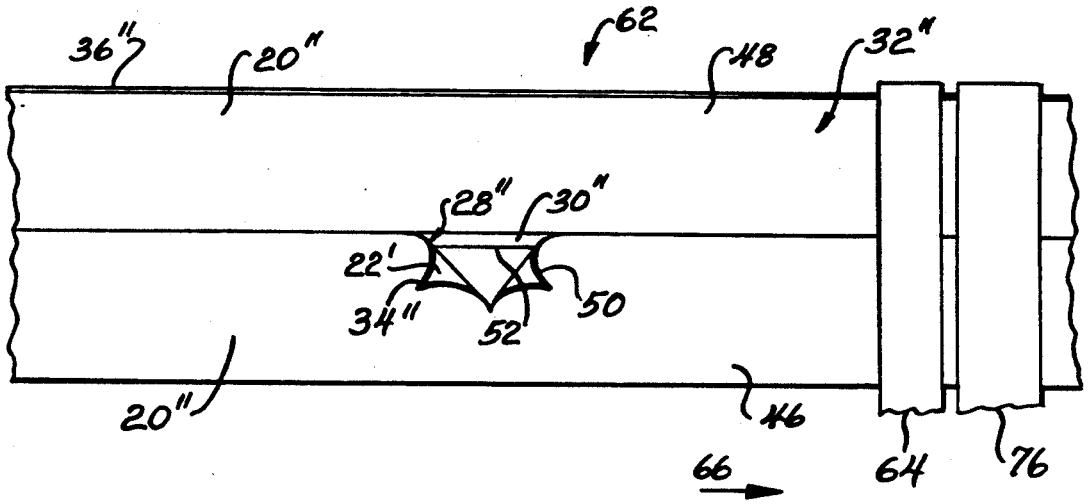
FIG. 5
FIG. 6
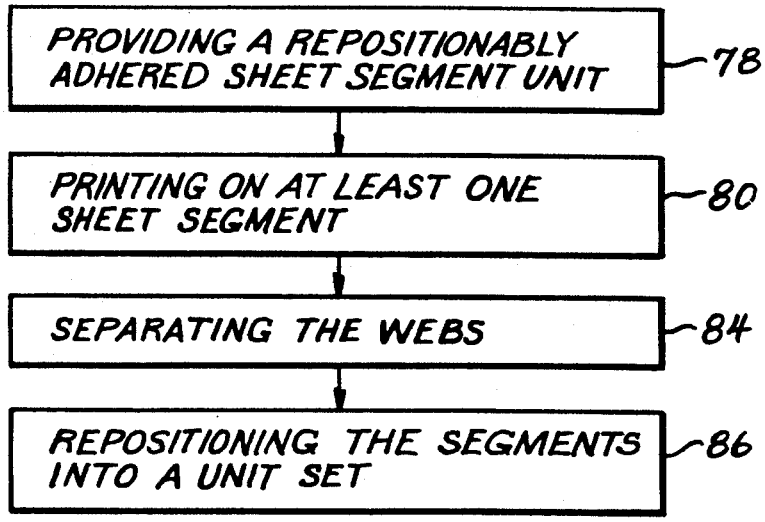

STRUCTURE FOR AND METHOD OF MAKING OVERLAPPING MULTIPART BUSINESS FORM UNIT SETS

BACKGROUND OF THE INVENTION

1. Technical Field

The present invention is directed toward overlapping multipart business forms such as so-called "unit sets" and more particularly toward a sheet segment unit for facilitating manufacture of such forms and a method of making such forms held together by a repositionable adhesive.

2. Background Art

Overlapping multipart or multiple ply business forms are well known in the art. Many such forms are typically in a pad configuration furnished in unit sets (as distinguished from continuous forms), each set being made up of a stack of several sheets of paper or "parts" which are attached to one another in the stack along at least one edge or margin of each sheet. Frequently, each sheet in a unit set is different from the others in some readily apparent way. For example, a sheet may be of a different color and bear a notation that it is to be retained or routed to a particular party, office, or functional organization. The sheets in such a unit set may be interleaved with carbon paper or bear as coatings on their top or bottom surfaces pressure-activated copy making material such as carbonless coatings of micro encapsulated ink. In many cases the unit set has a marginal strip or stub composed in part of a portion of each of the formed sheets, from which the remainder of at least one of the sheets can be detached. Often, the part is separated from the stub by a line of weakness such as a line of perforation.

Such forms are typically constructed by: 1) printing each sheet of the set, 2) collating the sheets into sets, 3) stacking the sets, 4) padding the sets by adhering the stack of sets along an edge by an adhesive, 5) allowing the adhesive to dry, and 6) breaking the stack into unit sets. This method is both time consuming because of the amount of handling and the period it takes the adhesive to dry. The process is also messy because it requires handling a liquid adhesive and storing the stacks of sets during drying. In addition, small scale printer shops often do not have the space to store drying stacks, cannot afford machinery to automate the process nor can they afford to provide the personnel necessary to manually perform this labor intensive operation—particularly where they do not print a sizable volume of multipart business form unit sets. Because small print shops cannot perform these operations, small businesses have a difficult time obtaining customized unit sets in small quantities. Large print shops are either not interested in such small orders or the cost of manufacturing the small orders are prohibitive to small businesses.

It is known in the art to construct such overlapping multipart business form unit sets by providing repositionable adhesive in a margin portion with or without permanent adhesive for attaching the sheets together. Such a structure is disclosed in Greig, U.S. Pat. No. 4,714,276. This structure provides numerous advantages over prior art structures. For example, individual sheets can be removed from a unit set and repositionably attached to other documents or objects for routing or filing purposes and the individual sheets are less likely to be torn during removal than when the sheets are torn along perforations. Thus, many consumers prefer multipart business form unit sets of this type.

Although the overlapping multipart business form unit sets held together at their margin portion by a repositionable adhesive have numerous advantages over prior art structures, they are difficult and expensive to assemble. These unit sets are typically manufactured in mass quantities by 1) printing indicia for each sheet of the unit set on a separate continuous rolled web, 2) re-rolling the webs, 3) collating the webs on a collating machine, 4) simultaneously with collating applying a repositionable adhesive strip, 5) cutting the collated webs into unit sets, and 6) stacking the units. The entire process is automated using large, complex and expensive machinery.

The process is made more difficult and more expensive when each unit set of a pad or group of unit sets is made of sheets each bearing an identical sequential number that varies in sequence from the sequential number on the other unit sets of the pad or group of unit sets. For example, when the set is an invoice and each part bears the same order number. When such numbers are included, it is much more difficult and time consuming to assure that each sheet of a unit set has the same number and that the unit sets are sequentially ordered.

Small print shops are not able to acquire the machinery necessary to manufacture these repositionably adhered multipart business form unit sets. Thus, small print shops can not compete in manufacturing such forms and, for the reasons described above, small businesses are, for all practical purposes, foreclosed from obtaining such customized forms and therefore denied their many benefits.

The present invention is directed toward a sheet segment unit set permitting small print shops and small businesses to benefit from the many advantages of repositionable adhesive multipart business form unit sets and a method of constructing overlapping multipart business form unit sets which overcomes one or more of the problems with the prior art assembly methods discussed forth above.

SUMMARY OF THE INVENTION

One aspect of the invention contemplates a repositionably adhered sheet segment unit set for building an overlapping multipart business form unit set. The repositionably adhered sheet segment unit set includes at least two sheet segments each having a front side and a back side and corresponding edges. The sheet segments are in side-by-side relation, such that adjacent edges overlap defining an interface. A repositionable adhesive strip is located on at least one of the overlapping edges of the adjacent segments defining an interface to releasably secure the sheet segments to each other. At least one of the front and back sides of at least one of the sheet segments has an image transfer medium coating.

The repositionably adhered sheet segment unit set can also include indicia on at least one of the front and back sides of at least one of the sheet segments. The image transfer medium coating may be a CB image transfer coating on the back of at least all but one of the segments and a CF image transfer coating on the front of at least all but one of these segments. In a preferred embodiment, the sheet segments are made of different papers, including papers of different weight, color or texture. Each sheet segment can include a line of perforation adjacent the interface for facilitating tearing off the portion of the segment bearing the repositionable adhesive strip.

In another aspect of the present invention, a repositionably adhered sheet segment continuous web includes at least two webs having a front side and a back side and corresponding longitudinal edges, the webs being in side-by-side relation such that adjacent longitudinal edges overlap and define and interface. A repositionable adhesive strip is located on one of the overlapping edges of the adjacent webs defining an interface to releasably secure the webs together. At least one of the front and back sides of at least one of the webs bears an image transfer medium coating. A transverse line of weakness divides the adhered webs into a plurality of connected sheet segment unit sets.

In a highly preferred embodiment, the connected sheet segments are stacked upon each other in a fanfold or zigzag folded stock. Also in a preferred embodiment, at least one of the front and back of at least one of the webs bears repetitive indicia, the repetitive indicia being on corresponding segments of each of the plurality of connected sheet segment unit sets. The webs may be made of different paper, including paper of different weight or color. A line of perforation may be included on each web adjacent the interface for facilitating tearing off the portion of the segment bearing the repositionable adhesive strip.

Another aspect of the present invention is a method of making repositionably adhered sheet segment units for manufacturing overlapping multipart business form unit sets. The method includes providing at least two webs having a front and a back side and corresponding longitudinal edges. An image transfer medium coating is provided on at least one of the front and back sides of at least one of the webs. The webs are located in a side-by-side relation and such that adjacent longitudinal edges overlap defining an interface. The overlapping edges are removably assembled together with a longitudinal strip of repositionable adhesive located on one of the overlapping edges of adjacent webs defining an interface. The removably assembled webs are transversely severed into repositionably adhered sheet segments unit sets.

In a preferred version of this method, the webs are repetitively printed with indicia by a printer and are transversely severed such that each repetition of indicia is on a separate repositionably adhered sheet segment unit set. Also, in a preferred version of this method, the image transfer medium coating is applied by applying a CB image transfer coating on the backs of at least all but one of the webs and applying a CF image transfer coating on the fronts of at least all but one of the webs. The webs can be made of different paper, including paper of different color, weight or texture.

Yet another aspect of the present invention is a method of making an overlapping multipart business form unit set. The method includes providing a repositionable adhesive sheet segment unit as described above. Indicia is printed on at least one of the sheet segments with a printer. The sheet segments are separated by breaking the adhesion at the overlapping edges while leaving the strip of repositionable adhesive intact on the web on which it is located. The segments are then repositioned so that the segments overlie one another with at least one corresponding edge aligned, with the image transfer medium coating between adjacent segments and with the overlying portion of the segments constituting the back of one segment and the front of a subjacent segment. The indicia may be simultaneously printed on more than one of the sheet segments with a non-impact printer.

The repositionably adhered sheet segment unit set and the repositionably adhered sheet segment continuous web of the present invention provide structures whereby small print shops may use their existing copiers and printers to produce customized overlapping multipart business form unit sets for customers of all sizes. The repositionably adhered sheet segment unit set can be used to produce such forms on a cut sheet printer. The repositionably adhered sheet segment continuous web can be used to produce such forms on a continuous feed fanfold printer. Because these embodiments of the present invention are compatible with standard printers and copiers, small print shops may now effectively compete in the production of customized multipart business forms and small business may now have a wide variety of outlets to obtain small quantities of customized multipart business forms to suit their needs. In addition, these embodiments facilitate construction of overlapping multipart business form unit sets using the inventive method discussed above, thus facilitating its many advantages.

The method of constructing overlapping multipart business form unit sets of the present invention has several advantages over prior art construction methods. To begin, each segment or part of the multipart business form may be simultaneously printed in a single pass through a printer. Simultaneous printing is a particular advantage where each segment of the multipart unit set contains an identical sequential number such as an order or serial number. In addition, the method of the present invention allows webs of paper of different colors and weights to be simultaneously printed and then expeditiously assembled into unit sets. The method of constructing overlapping multipart business form unit sets of the present invention also simplifies and stream-lines the unit set assembly procedure because the sheets of paper comprising the set are not required to be sequenced, collated and then manually edge padded. Instead, the repositionable adhesive bond need only be broken and the segments comprising the unit set repositioned and aligned to form the unit set. Thus, the expense of sequencing and collating are eliminated. Also, the method of the present invention decreases the time and space needed to produce multipart business form unit sets by eliminating the need to pad the unit sets, store them for drying and then sever the unit sets.

Other objects, advantages and features of the present invention will become more apparent from a consideration of the following specification taken in conjunction with the accompanying drawings.

BRIEF DESCRIPTION OF THE DRAWINGS

FIG. 1 is a perspective view of a stack of repositionably adhered sheet segment unit sets;

FIG. 2 is an exploded perspective view of an overlapping multipart business form unit set made in accordance with the present invention:

FIG. 3 is a perspective view of a repositionably adhered sheet segment continuous web according to the present invention;

FIG. 5 is a top view of repositionably adhered webs used to construct the repositionably adhered sheet segments according to the present invention;

FIG. 6 is a flow diagram illustrating the method of making an overlapping multipart business form unit set of the present invention.

DETAILED DESCRIPTION OF THE PREFERRED EMBODIMENT

Figure 4:
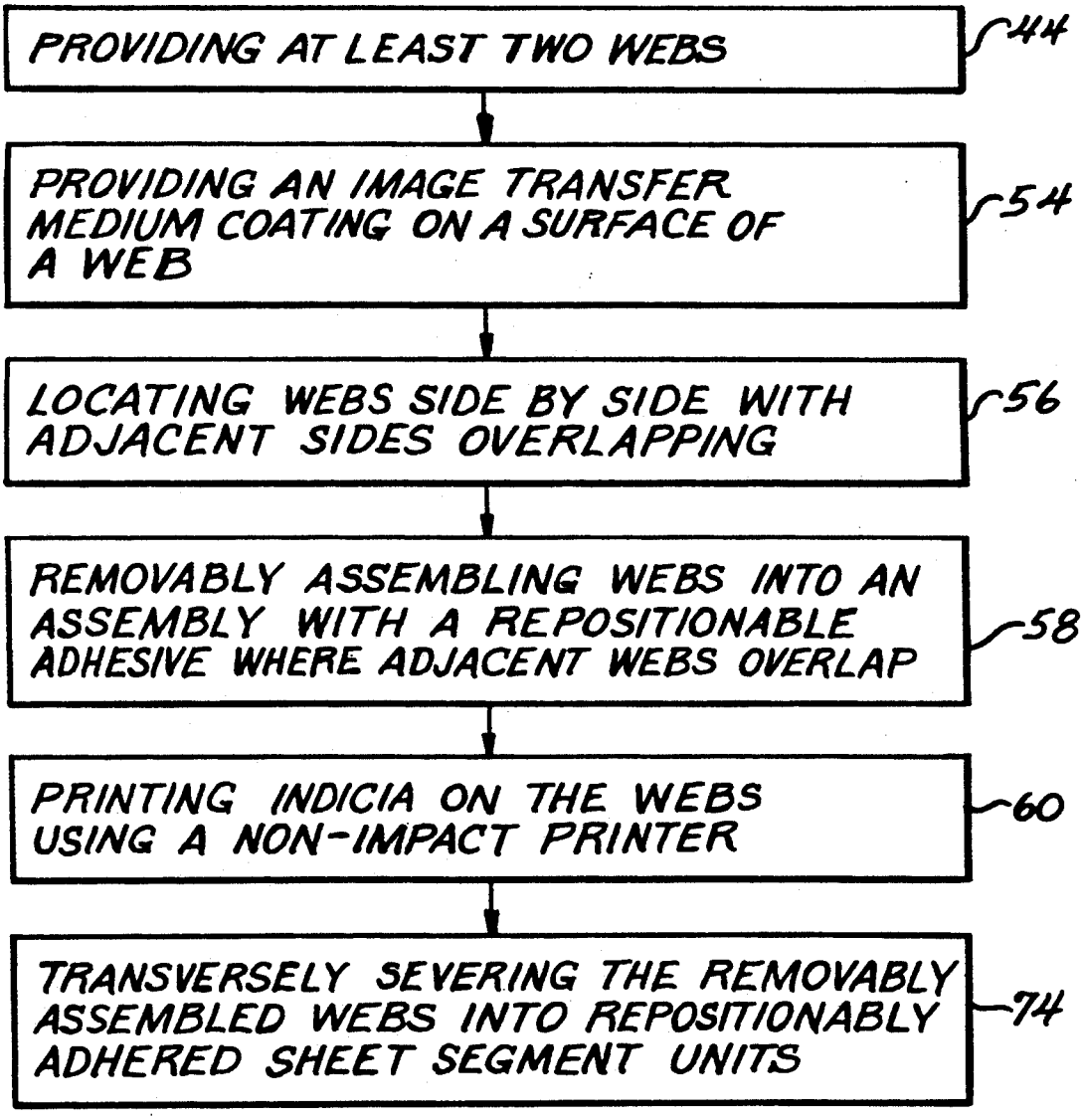
FIG. 4 is a flow diagram illustrating the method of making a repositionably adhered sheet segment unit of the present invention.

A stack 10 of repositionably adhered sheet segment unit sets 12 made according to the invention is illustrated in FIG. 1. Each repositionably adhered unit set 12 has a plurality of sheet segments (or parts) including a top segment 14 and a bottom segment 16. The invention contemplates any number of sheet segments, although only two are illustrated for simplicity.

Indicia 18 is provided on each segment 14, 16 of the unit set 12. The indicia 18 on each segment may be identical or it may differ from one segment to the next in whole or in part as seen in FIG. 1. However, it is within the contemplation of the preferred embodiment that no indicia 18 be provided on the sheet segments.

Each sheet segment 14, 16 has a front 20 and a back 22. In addition, each sheet segment has corresponding edges including a top edge 24 of the top sheet 14 and a top edge 26 of the bottom sheet 16. The sheet segments 14, 16 are shown in a side-by-side relation such that the adjacent top edges 24, 26 overlap defining an interface 28.

A repositionable adhesive strip 30 is located on the front 20 of the bottom sheet segment 16 at the interface 28. As will be readily appreciated, the repositionable adhesive strip 30 could also be disposed on the back 22 of the top sheet segment 14 at the interface 28.

Referring to FIG. 2, an image transfer medium coating 32 is disposed between the sheet segments 14, 16 when they are in their assembled form. Thus, the image transfer coating medium 32 is disposed on at least one of the back 22 of the top sheet segment 14 or the front 20 of the bottom sheet segment 16. In the preferred embodiment, the image transfer medium coating 32 is made of two parts consisting of a conventional CB (coated back) coating 34 applied to the back 22 of the top sheet segment 14 and a conventional CF (coated front) coating 36 applied to the front 20 of the bottom sheet 16. Those skilled in the art will readily appreciate that the image transfer coating 32 may take many other forms, including a single CFB coating of micro-encapsulated ink applied to one or both of the front 20 of the bottom sheet 16 or the back 22 of the top sheet 14.

A line of weakness 38 such as perforations are on each sheet segment 14, 16 adjacent the interface 28.

The repositionable adhesive strip 30 may be of any repeatedly releasably self-stick adhesives having the properties of permanently adhering to the surface upon which it is applied yet not transferring to any other surfaces with which it comes in contact. Moreover, the repositionably adhesive must have sufficient adhesive strength to hold two sheet segments together while at the same time not damaging or tearing each sheet segment upon separating the sheet segments. Several adhesives are known in the art as having these properties, including "3M-1000" manufactured by Minnesota Mining and Manufacturing Company and "Liquid Magnet" manufactured by PDI, Inc.

FIG. 3 illustrates a continuous forms assembly of a plurality of the above-described repositionably adhered sheet segment unit sets 12' joined along their edges 40. The repositionably adhered sheet segment unit sets 12' are illustrated without indicia, although it is readily apparent from FIG. 1 that indicia may be included. Corresponding reference numerals are used (only with the inclusion of a single prime (')) because the repositionably adhered unit sets 12' are in all ways identical to the repositionably adhered sheet segment unit sets 12 of FIG. 1 except they are joined along the edges 40 by a line of weakness 42 such as a line of perforation which allows separation into individual form lengths.

As illustrated in FIG. 3, the stack 10' of repositionably adhered sheet segment unit sets 12' is formed in a fanfold or zigzag folded stock by having adjacent repositionably adhered sheet segment unit sets 12' lie upon each other front 20' to front 20' and back 22' to back 22' in an alternating manner.

The repositionably adhered sheet segment units 12 and 12' may be made of paper having different weight, color or texture as desired. For example, where the top sheet segments 16 is to be given to a customer and the bottom sheet segment 14 is to be retained by a seller of goods, it may be advantageous to have the segments 14, 16 be of different colors. Or, where the top segment 14 must be of a heavy stock paper, for example, where the top segment 14 is to be used as a postcard to be deposited in the United States mail and the bottom sheet 16 is to be retained for record keeping purposes, it may be advantages to have the bottom sheet 16 be of a weight lessor than the top sheet 14 for cost saving purposes.

The method of making repositionably adhered sheet segment units 12 for manufacturing overlapping multipart business form unit sets is illustrated in the flow diagram of FIG. 4 and discussed with referenced to FIG. 5.

The first step 44 is providing at least two webs including a top web 46 and a bottom web 48. As should be readily appreciated, any number of webs may be provided to suit the needs of a particular application. For simplicity sake, the present invention is discussed in terms of only two webs. The webs may be of different weights, colors or textures as desired. As illustrated in FIG. 5, the top edge 50 of the top web 46 corresponds to the top edge 24 of the top sheet 14 and the top edge 52 of the bottom web 48 corresponds to the top edge 26 of the bottom sheet segment 16. For the sake of simplicity, because the webs 46, 48 and their structure in a combined state will conform substantially to the top and bottom sheet segments 14, 16 of FIG. 1, identical reference numerals will be used to identify their elements only with the inclusion of a double prime (") after each reference numeral.

The second step 54 is providing an image transfer medium coating 32" on at least one of the front 20" and back 22" sides of at least one of the webs. The image transfer medium coating may be in the form of a CB coating 34" and CF coating 36" discussed above with respect to the repositionably adhered sheet segment units 12.

In the third step 56, the webs are located in side by side relationship such that the top edge 50 of the top web 46 overlies the top edge 52 of the bottom web 48 (see FIG. 5). The overlapping portions define an interface 28".

In the fourth step 58, the webs 46, 48 are removably assembled together with a longitudinal strip of repositionable adhesive 30". The repositionable adhesive 30" may also be applied simultaneously with the step of locating the webs 46, 48 in side-by-side relation. With reference to FIG. 5, the repositionable adhesive strip 30" is applied to the front 20" of the top edge 52 of the bottom web 48. It should be appreciated that the repositionable adhesive strip 30" may also be applied to the back side 22" of the top sheet 46 along its top edge 50.

In the fifth step 60, the web assembly 62 is passed through a press or printer 64 in the direction indicated by the arrow 66. Thus, the assembly 62 may be continuously fed through the printer 64 and indicia repetitively printed on one or both webs in the direction of assembly movement. Of course, the printing may be oriented transverse to the direction of assembly movement or opposite the direction of assembly movement if a multipart business form unit 68 having a different margin than that indicated in FIG. 2 is preferred.

Each printing of the web assembly 62 constitutes a repetition of indicia 18. With each repetition of indicia a different sequential number 70 may be applied if desired. Thus, each unit set can be identified by a sequential number, as for example, a sequential number for an invoice or an order form. The indicia can also be printed in such a manner that the printing on each sheet of an assembled unit set is aligned. For example, the printing may be done in such a manner that when the sheets are repositioned as illustrated in FIG. 2, the blank spaces 72 will be aligned.

In the sixth step 74, the web assembly 62 is passed through a shear 76 and transversely severed into repositionably adhered sheet segment units 12.

Preferably, in step 54 when the webs 46, 48 are provided with an image transfer medium coating, the coating is provided such that a CB coating 34" is applied to the back 22" of the top web 46 and a CF coating 36" is applied to the front 20" of the bottom web 48. Thus, when the webs are located in a side-by-side relation as in step 56, the top web 46 will not have a CF image transfer coating on its front side 20" and will not have an interface 28" on its front side. Furthermore, the bottom web 48 will not have an interface 28" on its back side 22" and it will not have a CB image transfer coating on its back side 22".

As will be readily appreciated, if repositionably adhered sheet segment units 12 without printing are required, step 60 may be eliminated.

A method of making an overlapping multipart business form unit set is illustrated in the flow diagram of FIG. 6. Again, it should be understood that while the multipart business form unit set is discussed in terms of having only two sheet segments 14, 16, any number of sheet segments is also within the contemplation of the present invention.

The first step 78 is providing a repositionably adhered sheet segment in accordance with the present invention as illustrated in and described with reference to FIG. 1. The repositionably adhered sheet segment 12 may contain preprinted indicia 18 although such indicia is not necessary to practice the invention. Such preprinted indicia may be desired where the multipart business form unit set 68 is to be an invoice or other standardized form.

The second step is printing indicia on at least one of the sheet segments 14, 16. Preferably, the repositionably adhered unit sets 12 are repetitively printed with a non-impact printer 82 such as a Xerox 9700. The sheets are fed into the printer 82 in a direction indicated by the arrow 84. Upon printing the indicia 18 may be oriented in opposite directions as indicated in FIG. 1, although such orientation is not required and is in fact a function of the purpose to which the unit assembly 68 will be put.

The third step 84 is separating the sheet segments 14, 16 by breaking the adhesion at the interface 28. Because of the nature of the repositionable adhesive strip 30, the repositionable adhesive strip 30 will remain adhered to the surface upon which it was applied.

The fourth step 86 is repositioning the segments so that the segments overlie one another to make a multipart business form unit sets 68. The repositioning is best illustrated with reference to FIG. 2. The segments are repositioned so that the top edges 24, 26 of the top and bottom sheet segments 14, 16 respectively are aligned and the remaining portion of the top sheet segment 14 overlies the bottom sheet segment 16. In this manner, the image transfer medium coating 32 is between the adjacent segments and the overlying portion of the segments constitutes the back 22 of the top sheet segment 14 and the front 20 of the bottom sheet segment 16. The repositioning is preferably done manually, although it is within the contemplation of the invention that this step be mechanized.

During the printing step 80, the segments may be printed with a sequential number 70. As will be readily appreciated, when the sheets are repositioned as in step 86, each unit set 68 will bear the same sequential number 70. Also, the segments may be printed such that the blank space 72 will be aligned as illustrated in FIG. 2 upon repositioning. Printing may also customize standard forms having preprinted indicia. For example, the name of a business may be inserted during this printing to an otherwise standard invoice form.

In a modification of the method illustrated in FIG. 6, a repositionably adhered sheet segment continuous web 12' may be substituted. If such a substitution is made, the perforations 38 may be broken before printing and the stack of repositionably adhered unit sets 10' illustrated in FIG. 3 will then be the equivalent of the stack of repositionably adhered unit sets 10 of FIG. 1. The repositionably adhered unit sets are then handled in exactly the manner set forth in FIG. 6 as described above. However, it may be preferred to not break the perforations 42 prior to printing so that the stack of repositionably adhered unit sets 10' may be printed on a continuous feed fanfold printer 86 such as an IBM 3800. If such a printer is used, the stack 10' is fed into the printer 86 in the direction indicated by the arrow 88. Then, following printing, the additional step of breaking the perforation 38 must be included. Thereafter, the unit assembly 68 may be constructed in the method illustrated in FIG. 6.

The repositionably adhered sheet segment unit set and the repositionably adhered sheet segment continuous web of the present invention facilitate printing of overlapping multipart business forms joined by a repositionable adhesive on standard copiers and printers found in small print shops or many businesses. Thus, the small print shops can prepare customized overlapping multipart business form unit sets for customers of all sizes without having to acquire costly equipment required by other techniques or face storage and handling problems associated with conventional padding of multipart business form unit sets. In addition, these structures make available to small businesses customized multipart business forms unit sets to suit their needs. Or, business having such printing or copying capacity may produce their own customized multipart business forms.

The methods of constructing overlapping multipart business form unit sets disclosed herein facilitate simultaneous printing in a single pass through a printer of multipart business forms. Thus, sequential numbering of such forms is facilitated. Moreover, the methods may be employed by small printing shops, allowing them to compete in a lucrative area as well as providing a source of small quantities of multipart business form unit sets to small businesses. In addition, business having such printing capacity may produce their own customized multipart business forms.

I claim:

1. A method of making repositionably adhered sheet segment units for manufacturing overlapping multipart business form unit sets comprising:

(a) providing at least two webs each having a front and a back and corresponding longitudinal edges;

(b) providing an image transfer medium coating on at least one of the front and back of at least one of said webs;

(c) locating said webs in side by side relation relative to each other and such that adjacent longitudinal edges overlap defining an interface and all of the front of each web not defining an interface is uncovered by the other webs;

(d) assembling said overlapping edges together such that they are releasable with a longitudinal strip of repositionable adhesive located on one of the overlapping edges of the adjacent webs defining an interface; and transversely severing the assembled webs into repositionably adhered sheet segment units.

2. The method of claim 1 wherein step b) comprises:

applying a CB image transfer coating on the backs of at least all but one of said webs; and applying a CF image transfer coating on the fronts of at least all but one of said webs.

3. The method of claim 2 wherein in step c) the webs are located in side by side relation such that one of said webs does not have an interface on its front and this web also is a web not having a CF image transfer coating on its front and one of said webs does not have an interface on its back and this web is a web not having a CB image transfer coating on its back.

4. The method of claim 1 including an additional step before step e) comprising:

passing the assembled webs through a printing station and simultaneously repetitively printing indicia on the fronts of the webs with a printer.

5. The method of claim 1 including an additional step before step e) comprising:

passing the assembled webs though a printing station and simultaneously repetitively printing indicia on the fronts of the webs with a non-impact printer.

6. The method of claim 1 wherein in step a) at least two of the webs provided comprise different paper.

7. The method of claim 1 wherein in step a) at least two of the webs provided comprise paper of different weights.

8. The method of claim 1 wherein in step a) at least two of the webs provided comprise paper of different colors.

9. The method of claim 1 wherein in step a) only two webs are provided.

10. A method of making an overlapping multipart business form unit set comprising:

a) providing a repositionably adhered sheet segment unit comprising:

at least two sheet segments having a front and a back and corresponding segments being in side-by-side relation relative to each other such that adjacent edges overlap defining an interface and all of the front of each web not defining an interface is uncovered by the other webs;

a repositionable adhesive strip located in one of the overlapping edges of adjacent webs defining the interface; and an image transfer medium coating on at least one of the front and back of at least one of the segments;

b) printing indicia on at least one of said sheet segments with a printer;

c) separating the sheet segments by breaking the adhesion at the overlapping edges while leaving the strip of repositionable adhesive intact on the web on which it is located; and d) repositioning the segments so that the segments overlie one another with at least one corresponding edge aligned, with the image transfer medium coating between adjacent segments and with the overlying portion of the segments constituting the back of one segment and the front of a subjacent segment.

11. The method of claim 10 wherein the repositionably adhered sheet unit of step a) has a transfer medium coating comprising:

a CB image transfer coating on the back of at least all but one of said segments; and a CF image transfer coating on the front of at least all but one of said segments.

12. The method of claim 10 wherein the repositionably adhered sheet segment unit of step a) has indicia on at least one of the front and the back of at least one of the sheet segments.

13. The method of claim 10 wherein the repositionably adhered sheet segment unit of step a) is comprised of sheet segments comprising different paper.

14. The method of claim 10 wherein the repositionably adhered sheet segment unit of step a) is comprised of sheet segments comprising paper of different weights.

15. The method of claim 10 wherein the repositionably adhered sheet segment unit of step a) is comprised of sheet segments comprising paper of different colors.

16. The method of claim 10 wherein in step b) indicia is simultaneously printed on more than one of said sheet segments with a non-impact printer.

17. A repositionably adhered sheet segment unit set for building an overlapping multipart business form unit set comprising:

at least two sheet segments having a front and a back and corresponding edges, said sheet segments being in side-by-side relation relative to each other such that adjacent edges overlap defining an interface and all of the front of each web not defining an interface is uncovered by the other webs;

a repositionable adhesive strip being located on one of the overlapping edges of adjacent segments defining an interface; and an image transfer medium coating on at least one of the front and back of at least one of the segments.

18. The repositionably adhered sheet segment unit set of claim 17 further including indicia on at least one of the front and the back of at least one of the sheet segments.

19. The repositionably adhered sheet segment unit set of claim 17 wherein the image transfer medium coating comprises:

a CB image transfer coating on the back of at least all but one of said segments; and a CF image transfer coating on the front of at least all but one of said segments.

20. The repositionably adhered sheet segment unit of claim 19 wherein the sheet segments are in a side-by-side relation relative to each other such that one of said segments does not have an interface on its front and this web also is the web not having a CF image transfer coating on its front and one of said webs does not have an interface on its back and this web is the web not having a CB imager transfer coating on its back.

21. The repositionably adhered sheet segment unit of claim 17 wherein the sheet segments comprise different paper.

22. The repositionably adhered sheet segment unit of claim 17 wherein the sheet segments comprise paper of different weights.

23. The repositionably adhered sheet segment unit of claim 17 wherein the sheet segments comprise paper of different colors.

24. The repositionably adhered sheet segment unit set of claim 17 further including a line of perforation on each sheet segment adjacent the interface for facilitating tearing off the portion of the segment bearing the repositionable adhesive strip.

25. A repositionably adhered sheet segment continuous web comprising:

at least two webs having a front and a back and corresponding longitudinal edges, said webs being in side-by-side relation relative to each other such that adjacent edges overlap defining an interface and all of the front of each web not defining an interface is uncovered by the other webs;

a repositionable adhesive strip being located on one of the overlapping edges of adjacent webs defining an interface;

an image transfer medium coating on at least one of the front and back of at least one of the webs; and a transverse line of weakness dividing the adhered webs into a plurality of connected sheet segment unit sets.

26. The repositionably adhered sheet segment continuous web of claim 25 wherein the connected sheet segments are stacked upon each other in a fanfold.

27. The repositionably adhered sheet segment continuous web of claim 25 further including indicia on at least one of the front and back of at least one of the webs forming the plurality of connected sheet segment unit sets, the indicia being on each of the plurality of connected sheet segment unit sets.

28. The repositionably adhered sheet segment continuous web of claim 25 wherein the webs comprise different paper.

29. The repositionably adhered sheet segment continuous web of claim 25 wherein the webs comprise paper of different weight.

30. The repositionably adhered sheet segment continuous web of claim 25 wherein the webs comprise paper of different color.

31. The repositionably adhered sheet segment continuous web of claim 25 further including a line of perforation on each web adjacent the interface for facilitating tearing off the portion of the segment bearing the repositionable adhesive strip.

* * * * *